US008690585B2

(12) United States Patent
An

(10) Patent No.: US 8,690,585 B2
(45) Date of Patent: Apr. 8, 2014

(54) ELECTRICAL CONNECTOR FOR LOW PROFILE APPLICATION

(75) Inventor: Alex Lon An, Chandler, AZ (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 123 days.

(21) Appl. No.: 13/267,901

(22) Filed: Oct. 7, 2011

(65) Prior Publication Data

US 2013/0090013 A1 Apr. 11, 2013

(51) Int. Cl.
*H01R 12/00* (2006.01)

(52) U.S. Cl.
USPC ..... 439/66

(58) Field of Classification Search
USPC ..... 439/66–71
See application file for complete search history.

(56) References Cited

U.S. PATENT DOCUMENTS

| | | | | |
|---|---|---|---|---|
| 4,592,617 | A * | 6/1986 | Seidler | 439/876 |
| 4,842,552 | A * | 6/1989 | Frantz | 439/557 |
| 5,108,312 | A * | 4/1992 | Sampson | 439/607.35 |
| 5,730,606 | A | 3/1998 | Sinclair | |
| 6,186,797 | B1 * | 2/2001 | Wang et al. | 439/66 |
| 6,241,531 | B1 * | 6/2001 | Roath et al. | 439/66 |
| 6,482,031 | B1 * | 11/2002 | Chen et al. | 439/567 |
| 6,561,819 | B1 | 5/2003 | Huang et al. | |
| 6,881,070 | B2 * | 4/2005 | Chiang | 439/66 |
| 6,913,469 | B2 * | 7/2005 | Chiang | 439/66 |
| 6,984,130 | B2 * | 1/2006 | Richter et al. | 439/66 |
| 6,994,566 | B2 * | 2/2006 | You | 439/66 |
| 7,097,517 | B2 | 8/2006 | Ma | |
| 7,284,993 | B1 | 10/2007 | Ju | |
| 7,791,443 | B1 * | 9/2010 | Ju | 336/107 |
| 8,192,206 | B1 * | 6/2012 | Ju | 439/66 |
| 8,277,230 | B2 * | 10/2012 | Huo et al. | 439/66 |
| 2011/0076862 | A1 | 3/2011 | Yeh | |

* cited by examiner

*Primary Examiner* — Truc Nguyen
(74) *Attorney, Agent, or Firm* — Wei Te Chung; Ming Chieh Chang

(57) ABSTRACT

An electrical connector for electrically connecting a central processing unit (CPU) to a printed circuit board (PCB) comprises an insulating housing having a plurality of passageways extending from a top surface to a bottom surface and a plurality of terminals received in the corresponding passageways. Each terminal includes a horizontal base portion with a solder ball attached thereto, a pair of upper legs extending upwardly from one end of the base portion and a pair of lower legs extending downwardly from the other end of the base portion. The upper legs abut against the top surface of the insulating housing and the lower legs abut against the bottom surface of the insulating housing for retaining the terminals in the insulating housing.

19 Claims, 4 Drawing Sheets

ELECTRICAL CONNECTOR FOR LOW PROFILE APPLICATION

BACKGROUND OF THE INVENTION

1. Field of the Invention

The present invention relates to an electrical connector, and more particularly to an electrical connector having a plurality of contacts configured for receiving and mating with ball-shaped counterpart for low profile application.

2. Description of Related Art

A conventional electrical connector electrically connecting a central processing unit (CPU) to a printed circuit board (PCB) disclosed in U.S. Pat. No. 7,097,517 issued to Ma on Aug. 29, 2006 comprises an insulating housing defining a plurality of passageways extending therethrough and a plurality of terminals received in the insulating housing. Each terminal has a vertical plate-like base portion received in the passageway for retaining the terminal in the insulating housing, an elastic arm bending upwardly from one side of the base portion and a soldering portion bent downwardly from the base portion. The elastic arm extends beyond the top surface of the insulating housing and forms a contacting end at a distal end thereof for contacting with a conductive pad of the CPU. The soldering portion is perpendicular to the base portion and soldered to the PCB through a solder ball to achieve electrical connection between the electrical connector and the PCB. A plurality of protrusions extend outwardly from two sides of the base portion and engage with sidewalls of the passageway to stably retain the terminal in the insulating housing.

With the trend toward high-speed input/output and miniaturization in computer technology, the electrical connectors are required to become more smaller while the density of the terminals are becoming more bigger. Due to the height of the terminal, the electrical connector has a high profile which does not meet with requirement for miniaturization.

Hence, it is desirable to provide an improved electrical connector to overcome the aforementioned disadvantages.

SUMMARY OF THE INVENTION

Accordingly, an object of the present invention is to provide an electrical connector with improved contacts for low profile application.

According to one aspect of the present invention, an electrical connector for electrically connecting a central processing unit (CPU) to a printed circuit board (PCB) comprises an insulating housing having a top surface and a bottom surface opposite to each other and defining a plurality of passageways extending therethrough and a plurality of terminals received in the passageways. Each terminal has a horizontal base portion, a first retention portion extending upwardly from one end of the base portion and a second retention portion extending downwardly from the other end of the base portion. The first retention portion abuts against the top surface of the insulating housing and the second retention portion abuts against the bottom surface of the insulating housing for retaining the terminal in the insulating housing.

Other objects, advantages and novel features of the invention will become more apparent from the following detailed description when taken in conjunction with the accompanying drawings, in which:

DETAILED DESCRIPTION OF THE INVENTION

Figure 1:
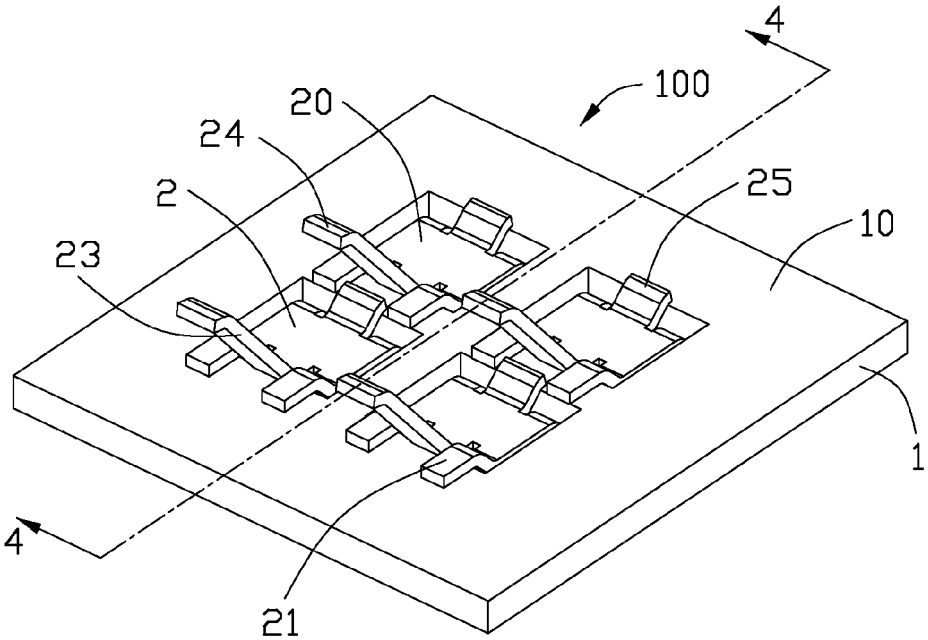
FIG. 1 is a perspective view of an electrical connector in accordance with the embodiment of the present invention.
Figure 2:
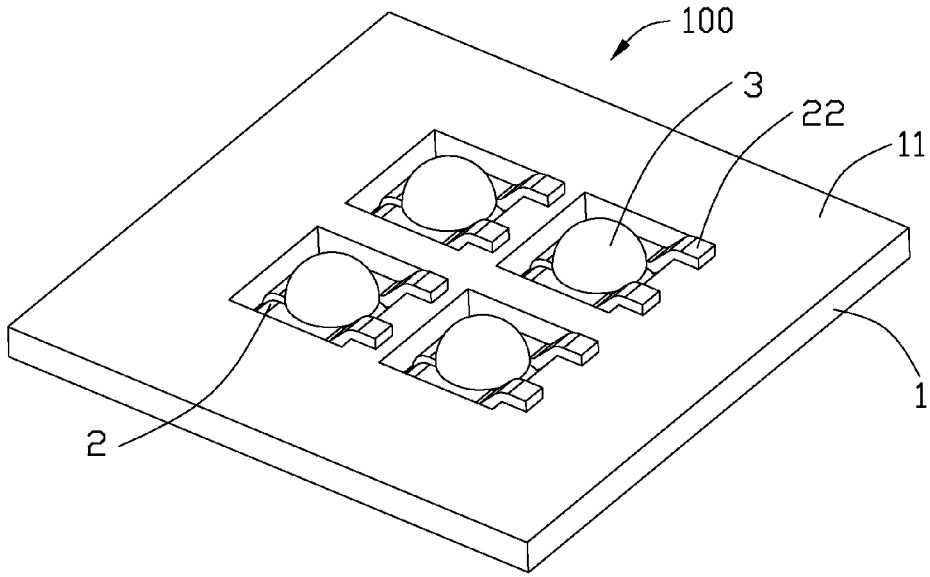
FIG. 2 is another, perspective view of the electrical connector shown in FIG. 1.

Reference will now be made to the drawings to describe the present invention in detail.

Referring to FIGS. 1-4, an electrical connector 100 in accordance with a preferred embodiment of present invention is disclosed. The electrical connector 100 used for electrically connecting a central processing unit (CPU) (not shown) to a printed circuit board (not shown) comprises an insulating housing 1 having a top surface 10 and a bottom surface 11 opposite to the top surface 10 and a plurality of terminals 2 received in the insulating housing 1. The insulating housing 1 defines a plurality of passageways 12 extending from the top surface 10 to the bottom surface 11 for receiving the terminals 2.

Figure 3:
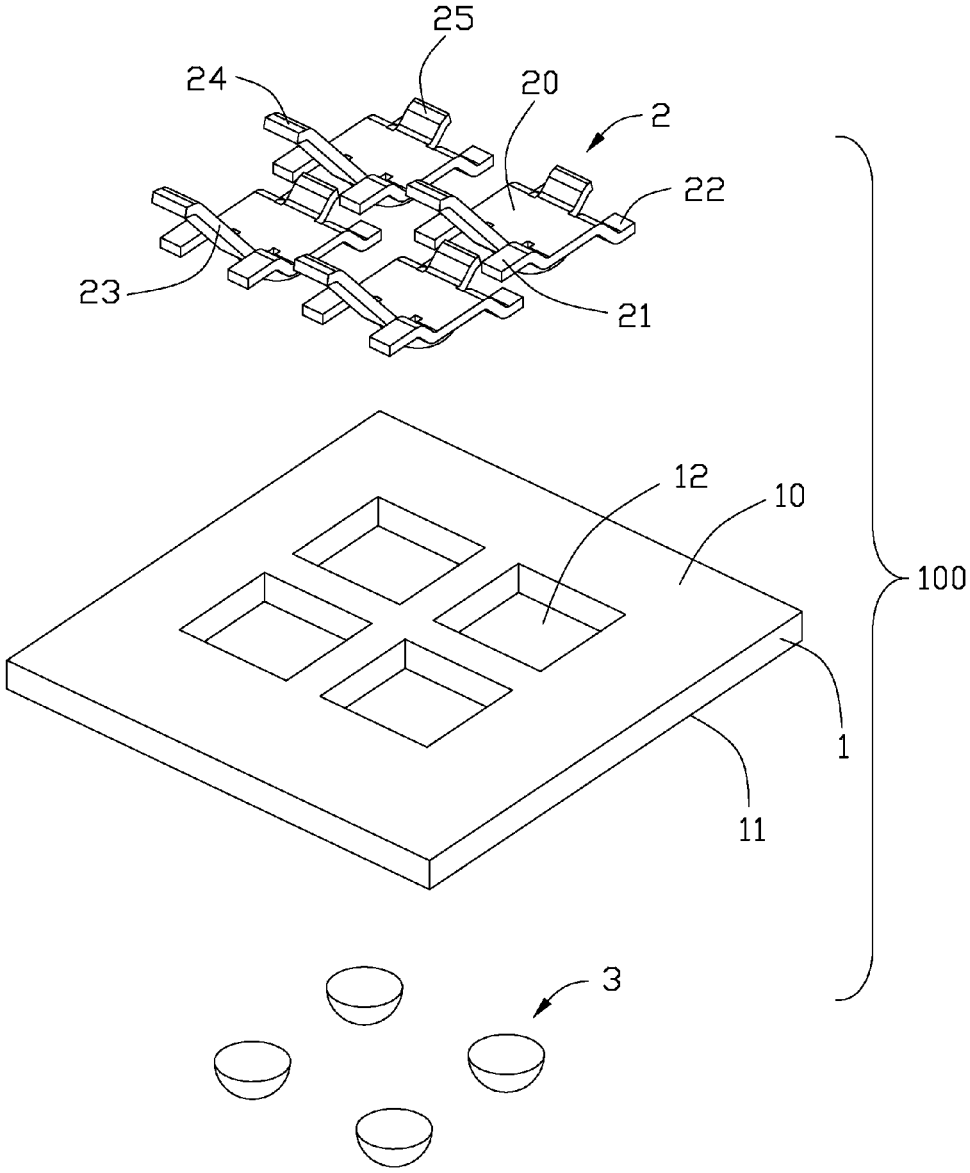
FIG. 3 is an exploded, perspective view of the electrical connector shown in FIG. 1.
Figure 4:
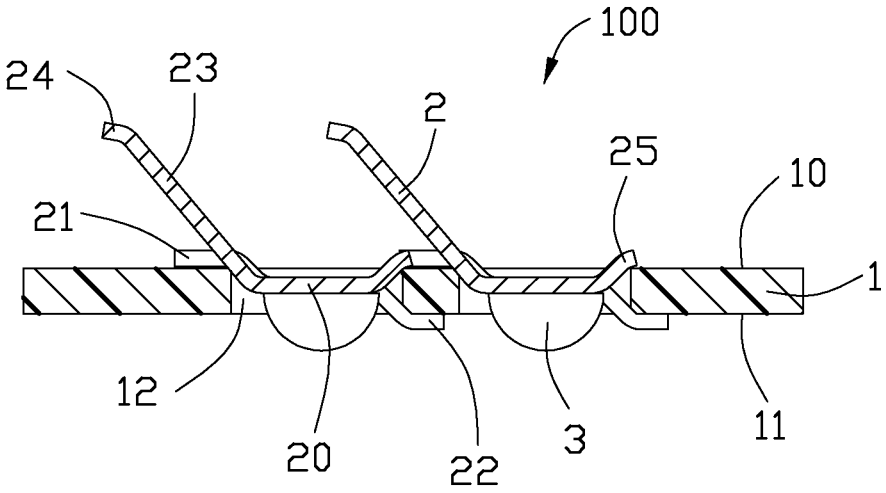
FIG. 4 is a cross-sectional view of the electrical connector, taken along line 4-4 in FIG. 1.

Referring to FIGS. 3-4, each terminal 2 has a horizontal plate-like base portion 20 received in the corresponding passageway 12 of the insulating housing 1, a pair of horizontal upper legs 21 extending obliquely and upwardly from one end of the base portion 20 and a pair of horizontal lower legs 22 extending obliquely and downwardly from the other end of the base portion 20. The base portion 20 has a solder ball 3 attached to a bottom thereof through surface-mount technology for soldering the base portion 20 to the PCB (not shown). The upper legs 21 abut against the top surface 10 of the insulating housing 1 and the lower legs 22 abut against the bottom surface 11 of the insulating housing 1 to retain the terminals 2 in the insulating housing 1.

Each terminal 2 defines an elastic arm 23 extending from a portion of the base portion 20 located between the pair of upper legs 21. The elastic arm 23 forms with a contacting end 24 at a distal end thereof for contacting with a conductive pad of the CPU (not shown). A rib 25 extends upwardly from a portion of the base portion 20 located between the pair of lower legs 22 and abuts against the top surface 10 of the insulating housing 1 for stably retaining the terminal 2 in the insulating housing 1. The upper legs 21, the base portion 20 and the lower legs 22 are located in different horizontal planes. The upper legs 21 are formed to a first retention portion of the terminal 2. The lower legs 22 are formed to a second retention portion of the terminal 2.

In assembling, firstly making the solder balls 3 attached to the base portions 20 of the terminals 2 through surface-mount technology; secondly making the rib 25 and the lower legs 22 of each terminal 2 disposed in the passageway 12 and clip the top and bottom surfaces 10, 11 of the insulating housing 1, respectively; thirdly pushing the upper legs 21 of the terminal 2 downwardly to make the upper legs 21 abut against the top surface 10 of the insulating housing 1. Then, the assembly of the electrical connector 100 is completed. The base portion 20 of the terminal 2 is received in the passageway 12 of the insulating housing 1.

The electrical connector 100 establishes electrical connection between the CPU (not shown) and the PCB (not shown) through the contacting ends 24 of the terminals 2 contacting with the conductive pads of the CPU (not shown) and the base portions 20 of the terminals 2 being soldered to the PCB (not shown) through the solder balls 3. The terminals 2 are retained in the insulating housing 1 through the horizontal upper legs 21 abutting against the top surface 10 of the insulating housing 1 and the horizontal lower legs 22 abutting against the bottom surface 11 of the insulating housing 1, so that the height of the terminal 2 is reduced and the insulating housing 1 for receiving the terminals 2 has a low height to meet with a low profile application.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting a central processing unit (CPU) to a printed circuit board (PCB), and comprising:

an insulating housing defining opposite top and bottom surfaces with a plurality of passageways extending therethrough; and a plurality of terminals each including a horizontal base portion received in the corresponding passageways, respectively, a first retention portion extending upwardly from one end of the base portion and a second retention portion extending downwardly from the other end of the base portion;

wherein the first retention abuts against the top surface of the insulating housing and the second retention abuts against the bottom surface of the insulating housing for retaining the terminal in the insulating housing; wherein the top surface of the base portion is lower than the top surface of the insulative housing.

2. The electrical connector as claimed in claim 1, wherein the first retention, the base portion and the second retention are located in different horizontal planes.

3. The electrical connector as claimed in claim 1, wherein the first retention of the terminal includes a pair of upper legs extending upwardly from the base portion, and wherein the second retention of the terminal includes a pair of lower legs extending downwardly from the base portion.

4. The electrical connector as claimed in claim 3, wherein the terminal has an elastic arm extending upwardly from the base portion and out of the top surface of the insulating housing, and wherein a top end of the elastic arm is located on an adjacent passageway.

5. The electrical connector as claimed in claim 4, wherein the elastic arm forms with a contacting end disposed at a distal end thereof, and wherein the elastic arm extends from the base portion and located between the pair of upper legs.

6. The electrical connector as claimed in claim 3, wherein the terminal has a rib extending upwardly from the base portion and located between the pair of lower legs, and wherein the rib clips the top surface of the insulating housing.

7. The electrical connector as claimed in claim 1, wherein the terminal has a rib extending upwardly from the base portion to clip the top surface of the insulating housing.

8. An electrical connector for electrically connecting a central processing unit (CPU) to a printed circuit board (PCB), and comprising:

an insulating housing having a top surface and a bottom surface opposite to each other and defining a plurality of passageways extending therethrough; and a plurality of terminals received in the corresponding passageways, respectively, each terminal including a horizontal base portion with a first retention portion extending upwardly and a second retention portion extending downwardly therefrom, the first retention first extending upwardly to the top surface of the insulating housing and then further extending in a horizontal direction parallel to the top surface for abutting against the top surface, the second retention extending below the bottom surface of the insulating housing and further extending in a horizontal direction parallel to the bottom surface for abutting against the bottom surface.

9. The electrical connector as claimed in claim 8, wherein the terminal has a rib extending upwardly from the base portion, and wherein the rib clips the top surface of the insulating housing.

10. The electrical connector as claimed in claim 8, wherein the base portion of the terminal has a solder ball attached thereunder.

11. The electrical connector as claimed in claim 8, wherein the terminal has an elastic arm extending upwardly and obliquely from the base portion to an adjacent passageway.

12. The electrical connector as claimed in claim 8, wherein the first retention portion, the base portion and the second retention portion are located in different horizontal planes.

13. An electrical connector comprising:

an insulative plate defining opposite upper and lower surfaces in a vertical direction;

a plurality of passageways extending through the insulative plate in the vertical direction between the opposite upper and lower surfaces;

a plurality of contacts disposed in the corresponding passageways, respectively, each of said contacts unitarily including a horizontal base portion lying in a plane perpendicular to said vertical direction, at least one first leg extending from a first lateral edge of the base portion in a first lateral direction and lying upon one of the upper surface and the lower surface, at least one second leg extending from a second lateral edge of the base portion in a second lateral direction opposite to the first lateral direction and lying upon the other of the upper surfaced and the lower surface, and a rib extending from the base portion to cooperate with one of the first leg and the second leg for sandwiching the insulative plate therebetween in the vertical direction so as to retain each of the contacts in position with regard to the corresponding passageway in both the vertical and horizontal directions.

14. The electrical connector as claimed in claim 13, wherein said first leg lies upon the upper surface and the second leg lies upon the lower surface.

15. The electrical connector as claimed in claim 13, wherein said rib extends from the second lateral edge and cooperates with the second leg to sandwich the insulative plate therebetween in the vertical direction.

16. The electrical connector as claimed in claim 15, wherein each of the contacts further defines a contacting section extending from the base portion around the first lateral edge away from the corresponding passageway and above the upper surface.

17. The electrical connector as claimed in claim 16, wherein in each of the contacts, a solder ball is attached on an undersurface of the base portion and extends below the lower surface.

18. The electrical connector as claimed in claim 16, wherein on each of the contacts, there are two first legs and one contacting section all extending from the first lateral edge under condition that the contacting section is located between the two first legs along the first lateral edge in a front-to-back direction perpendicular to both said vertical direction and said first and second lateral directions.

19. The electrical connector as claimed in claim 15, wherein on each of the contacts, there are two second legs and one rib all extending from the second lateral edge under condition that the rib is located between said two second legs along said second lateral edge in a front-to-back direction perpendicular to both said vertical direction and said first and second lateral directions.

* * * * *